US006568038B2

(12) United States Patent
Patelli et al.

(10) Patent No.: US 6,568,038 B2
(45) Date of Patent: May 27, 2003

(54) ASSEMBLY FOR GATHERING CARD SLIVER FOR PACKAGING THEREOF IN CANS OF VARIOUS SIZE

(75) Inventors: Silvano Patelli, Palazzolo Sull'oglio (IT); Piero Sangaletti, Palazzolo Sull'oglio (IT); Giovanni Battista Pasini, Palazzolo Sull'oglio (IT)

(73) Assignee: Marzoli S.p.A., Palazzolo Sull'oglio (IT)

( * ) Notice: Subject to any disclaimer, the term of this patent is extended or adjusted under 35 U.S.C. 154(b) by 0 days.

(21) Appl. No.: 10/191,721

(22) Filed: Jul. 9, 2002

(65) Prior Publication Data

US 2003/0024075 A1 Feb. 6, 2003

(30) Foreign Application Priority Data

Jul. 23, 2001 (IT) ..... MI2001A1569

(51) Int. Cl.[7] ..... D04H 11/00
(52) U.S. Cl. ..... 19/159 A; 19/159 R
(58) Field of Search ..... 19/159 A, 159 R, 19/150, 157, 65 A; 53/116, 118; 57/90, 281; 198/345.1, 345.3, 347.3

(56) References Cited

U.S. PATENT DOCUMENTS 3,221,374 A * 12/1965 Fornes ..... 19/159 R
3,323,177 A * 6/1967 Binder et al. ..... 19/159 A
3,426,390 A 2/1969 Whitehurst
3,426,391 A 2/1969 Whitehurst
5,339,615 A * 8/1994 Hauner ..... 57/281
5,390,484 A * 2/1995 Schwalm ..... 57/281
5,687,454 A * 11/1997 Langen ..... 19/159 A
5,815,888 A * 10/1998 Temburg ..... 19/159 A
6,209,285 B1 * 4/2001 Patelli et al. ..... 53/116
6,219,886 B1 * 4/2001 Wagner et al. ..... 19/159 A

FOREIGN PATENT DOCUMENTS

| | | | | |
|---|---|---|---|---|
| EP | 0967169 A1 | | 12/1999 | |
| FR | 2681056 A1 | | 3/1993 | |
| IT | 1 001 058 | * | 5/2000 | ..... D01G/15/64 |
| IT | 1 001 059 | * | 5/2000 | ..... D01G/15/64 |
| IT | 1 022 365 | * | 7/2000 | ..... D01G/15/46 |

OTHER PUBLICATIONS

EP Search Report.

* cited by examiner

*Primary Examiner*—Gary L Welch
(74) *Attorney, Agent, or Firm*—Hedman & Costigan, P.C.

(57) ABSTRACT

An automatic device for gathering and packaging card sliver in cans, the device having a plurality of gathering stations for cans of different size that have a rotary platform (35, 45) set underneath for rotation of the can receiving the sliver and of a distributor (50, 50') set above and driven by a motion of revolution, in which the cans are moved according to a single common path and with common members for imparting movement and for driving.

8 Claims, 7 Drawing Sheets

ASSEMBLY FOR GATHERING CARD SLIVER FOR PACKAGING THEREOF IN CANS OF VARIOUS SIZE

The present invention relates to the gathering of fibrous material in the form of a sliver or thin strand produced in the preparation of raw fibres for spinning, typically by cards or drawing frames set downstream of the carding operation. In the above processes of preparation of the raw fibres, the fibrous material in staple is opened in the form of individual fibres and set in parallel strands, any impurities or dirt that might be present are eliminated to a large extent, the fibres undergo a mixing or blending together, and a sliver of fibres is formed, which is gathered in large cans, then to be sent on to the subsequent stages of the process. In order to highlight the advantages and characteristics of the present invention, in what follows reference will be made to the sliver coming from a card of a cotton type, at the same time it being clearly emphasized that the invention may be applied also to slivers of different origin.

The operation of unloading, drawing and gathering the sliver produced on cards of a cotton type forms the subject of numerous patent applications in the name of the present applicant, for example the European patent applications EP-A-967 169, EP-A-1 001 058, EP-A-1 001 059, EP-A-1 022 365, to which the reader is referred for further details on the state of the art.

In particular, the subject of the present invention is the operation of gathering the sliver produced and the packaging thereof in the gathering can, and, in particular, modulated gathering thereof according to the requirements of the user of the sliver produced. Gathering of the sliver into cans renders the operations of carding upstream independent of the subsequent processes where the sliver is received.

FIG. 1 illustrates a conventional scheme for gathering the sliver into a can. From the card assembly 1 singularized and mixed fibres are obtained, which are gathered into a web and reduced to a sliver by a condenser. According to the patent applications referred to above, prior to delivery to the packaging device, the sliver is worked in a drawing assembly 2, which follows the condenser. In the gathering assembly the sliver 3 is recalled by the card assembly with two calenders (not shown in the figure) and set in overlapping coils in a cylindrical can 4 set underneath a rotating distributor 5. The said distributor is eccentric with respect to its supporting plate 6, which is above the filling can 4 and is driven according to two rotary motions: by a motion of revolution about its own center in the direction indicated by the arrow B, at a speed of the order of hundreds of revolutions per minute, and by a motion of rotation about the center of the plate 6 as indicated by the arrow C, at a much lower speed. The two combined rotations distribute the sliver 3 in the can 4 in coils, which translate their center according to circles that are coaxial with the plate 6, with an accumulation that progressively grows in thickness but not in level, as will be described in what follows.

At output from the card 1, on the path of the sliver 3 directed towards the gathering assembly 7 there are located the guide pulleys 8*a*, 8*b* and 8*c* in order to support it and reduce its free portion. In a position corresponding to one of the guide pulleys there is generally set a sensor, which detects the continuity of the sliver or any interruption of the sliver. In the latter case, the sensor in turn brings about stoppage of the machine. The main problems derive from the fact that the sliver produced in carding has a limited tensile strength and must be worked with all due caution. For this reason, the packaging in cans with overlapping coils enables the sliver to be subsequently taken out without generating any tensile forces that the limited strength of the sliver may not be able to withstand. For this purpose, in general the can 4 for gathering the sliver 3 is equipped with a mobile bottom 9, which is pushed upwards by an elastic element 10, for example a spring, which enables the bottom 9 to drop down accordingly as the process of depositing of the coils of sliver on its bottom progresses. With the above solution the free portion of sliver 3, from the distributor element 5 to the level at which the sliver is deposited remains extremely short. Both in the operation of gathering the sliver and in the subsequent operation, in which the sliver is taken from the can, the tensile stress exerted on the sliver is kept under control, and also a substantial effect of uncontrolled false drawing is prevented. In FIG. 1 are illustrated three cans 4, from left to right. The can 4 furthest to the left is an empty can, with its bottom 9 at the highest level. The initial depositing of sliver will take place with a free portion that corresponds to the limited difference in level that separates it from the crown or top of the plate 6, i.e., from the crown of the structure 15 which supports it. The can 4 in the middle is in the process of being filled, with its bottom 9 at an intermediate level. The can 4 furthest to the right is a full can, with its bottom 9 depressed to the minimum level by the winding of sliver deposited thereon. The cans are in general provided with wheels or balls for their movement on the treading surface. Alternatively, they may be displaced with auxiliary means, such as roller conveyors, trucks, and so forth.

The sliver produced by the card or by drawing frames set downstream of the card may have various destinations, which can basically be divided into two types. One type is that of the slivers destined to conventional spinning processes, which are to be sent onto subsequent drawing frames, for combing and then to ring spinning-machines. The gathering device 7 must then work for packaging the sliver in cans 4 of large diameter. The other type is that for uses which require smaller cans 4 and in general slivers with finer counts, for example open-end spinning. In the European patent application EP-A-342 116 there is described a device for gathering card sliver, which can operate in a single station with cans of different diameter, adapting the geometry of its members thereto.

As a rule in the textile industry the most widespread dimensions of cans are, generally speaking, a diameter of 18" for the small can and a diameter of 40" for the large can. Consequently, the process of gathering the sliver into two types of can takes place at different speeds of rotation and recall, also depending upon the tensile strength of the sliver, which varies according to the cases but which is always extremely small. Generally speaking, the gathering device for a given can size is not satisfactory for cans of another size both on account of problems of encumbrance and overall dimensions and according to the winding parameters involved.

In both types of gathering it is necessary for the linear speed of recall of the sliver 3 coming from the carding unit 1 by means of the calenders of the gathering unit 7 to correspond to the linear speed, to the speed of revolution B of the distributor 5, as well as to the depositing of the coils of sliver on the toroidal winding body inside the can; otherwise, the said depositing would not come about in a controlled way and according to the pattern described. The slow speed of rotation of the plate 6 about its center C is instead determined according to the number of turns of sliver that are to be deposited for each rotation of the plate and does not strictly depend upon the previous ones.

The above scheme for gathering the card sliver into a can presents certain drawbacks, which are more evident for gathering sliver into cans of larger size. A first drawback is identified in the complication, cost and encumbrance of the transmission for driving the plate 6, which must be set at the latter's periphery, in order to allow for passage of the sliver being gathered, which is deposited by the rotating distributor. Another problem derives from the fact that the point of arrival of the sliver 3 from the last return motion of the pulley 8*c* is positioned on the vertical line passing through the center of the plate 6 for reasons of symmetry. Consequently, the length of the path between the last return motion of the pulley 8*c* and the calender for recall inside the distributor 5 varies at each rotation of the distributor according to a sinusoidal pattern between a minimum length, when the hole 12 for entry of the sliver into the distributor 5 is close to the center of the plate 6, and a maximum length, when the hole 12 for entry of the sliver into the distributor 5 is further away from the center of the plate 6. This variation in length causes a pulsating tensioning, which may induce an undesired pull on the sliver.

The present invention relates to a device for gathering card sliver into cans of different dimensions and according to procedures adapted to their size which enables the drawbacks described above to be overcome.

In order to illustrate more clearly its characteristics and advantages, the present invention is described by way of non-limiting example, with reference to a typical embodiment illustrated in FIGS. 1 to 4.

Figure 2:
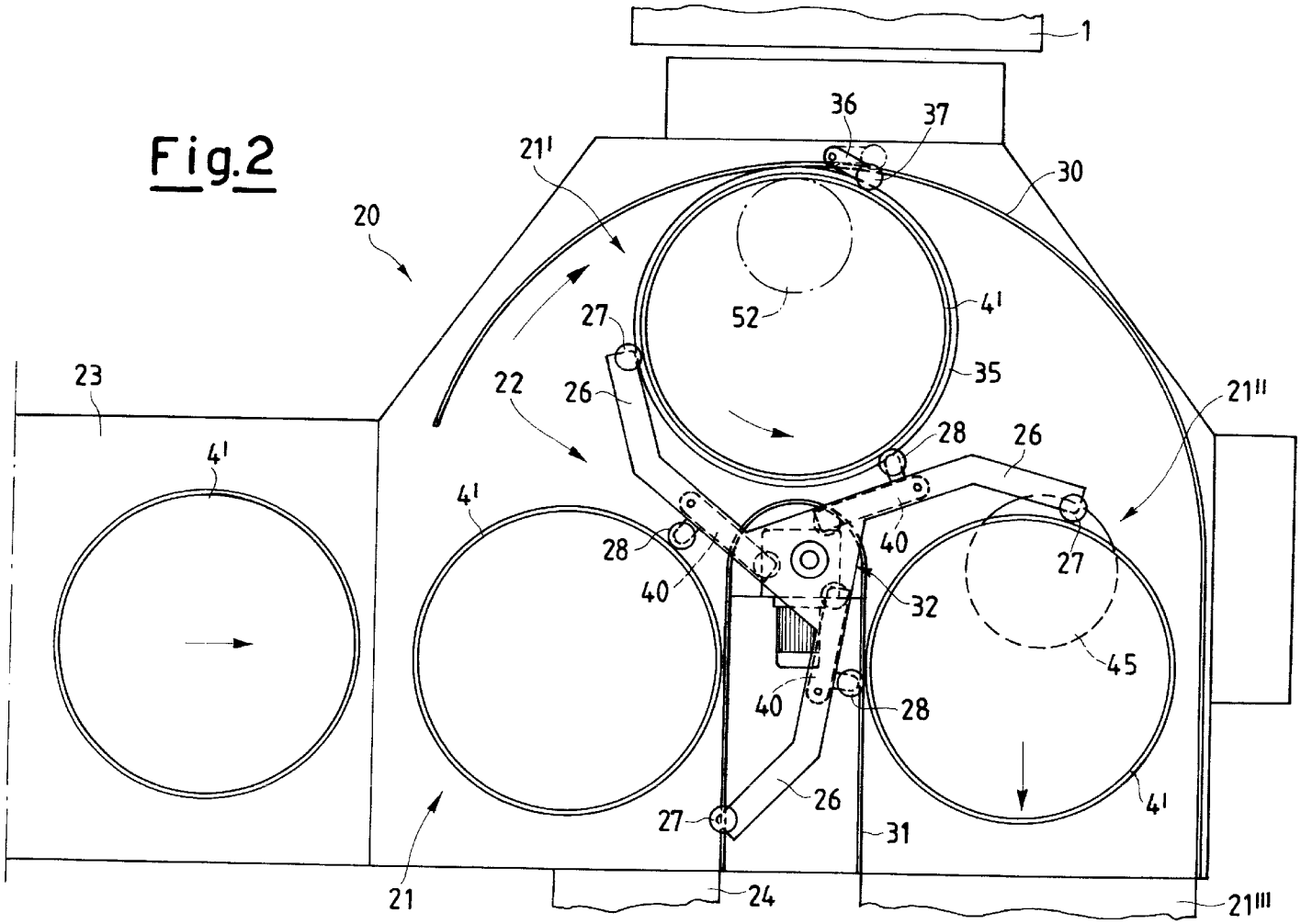
FIG. 2 illustrates an example of the structure in plan view of the gathering device according to the present invention, in use with cans of larger size.
Figure 3:
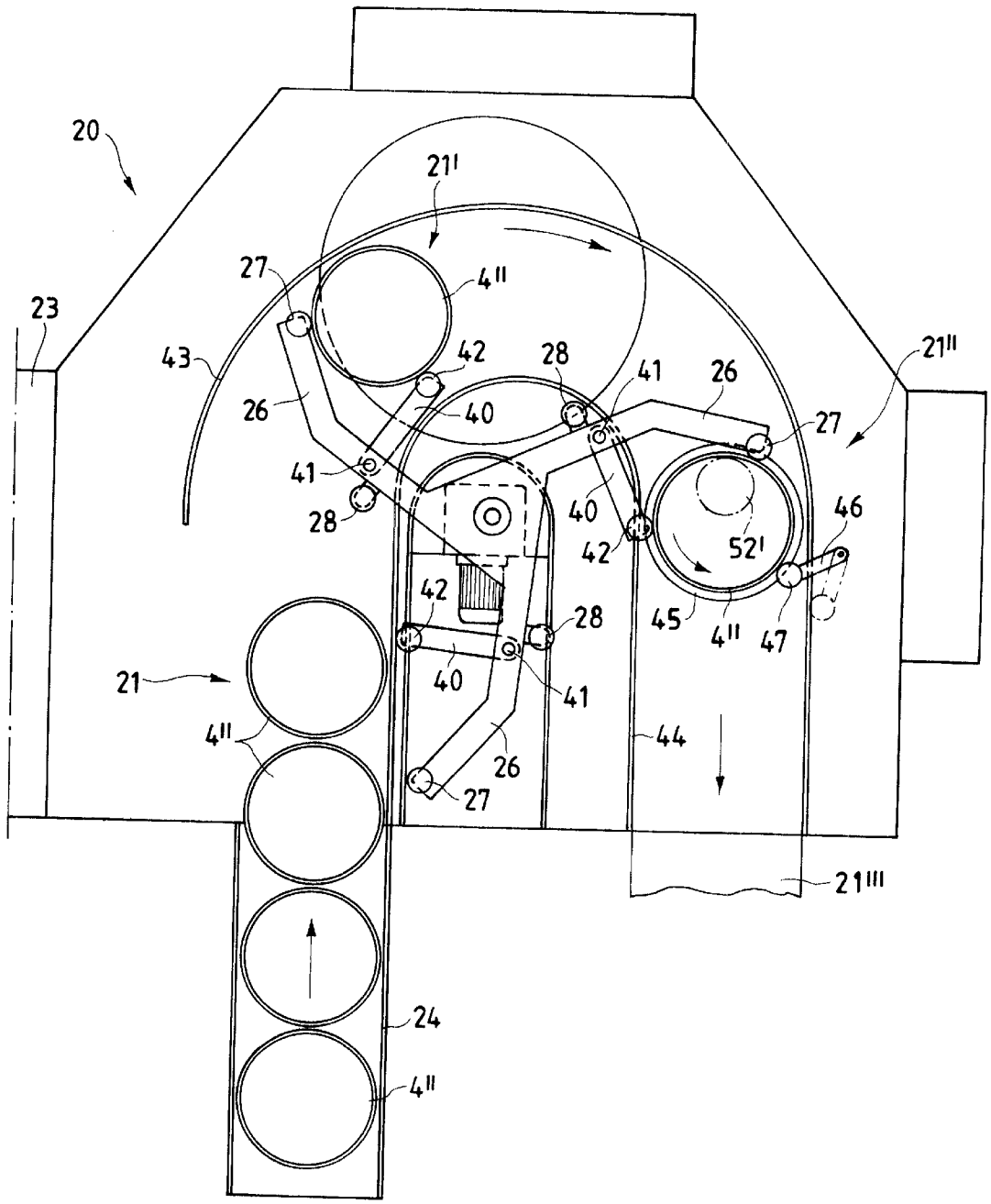

FIG. 3 reproduces the view of the device illustrated in FIG. 2, but in the configuration assumed by the device in use with cans of smaller size.

In the embodiment illustrated in FIG. 2, the device according to the present invention is shown in plan view and without any covering, in its working configuration with cans of large size, for example ones having a diameter of 40". The workstation 20 consists of three fixed positions 21, 21', 21" of the can, set 120° apart, between which the workstation 20 is moved in stepwise fashion by a rotating member 22.

The position 21 for receiving and waiting for the can that is arriving is served alternatively both according to a path 23, from which the cans 4' of large diameter arrive, and according to a path 24, from which the cans 4" of small diameter arrive, for example ones having a diameter of 18". The next position 21' is designed for gathering the sliver when working with large cans, whilst the last position 21" is the position for the large cans when they are travelling, whereas it is designed for gathering the sliver when working with small cans. From this latter position the cans 4 that have been filled are pushed towards the exit into the passage 21'".

The rotating member 22 for stepwise movement with clockwise rotation is driven by taking its motion from the motor members of the device 20 whenever a rotation step is made. Alternatively, it is possible to resort to an independent motor (not illustrated in the figures for reasons of simplicity). The rotating member 22 is made up of three main spokes or arms 26 set 120° apart, which are sickle-shaped; i.e., they are made up of two segments that form a very wide obtuse angle. In the advancing part of each end of each spoke or arm 26 there is set an idle wheel 27 for supporting the can 4' or 4" in its movement, whilst on its opposite hump, in the more internal part of the spoke or arm 26, is set another idle wheel 28 for supporting the can 4' that follows. In each cavity of the member 22, it is thus possible to rest a can 4' on two wheels 27 and 28, the said can 4' being pushed by its spoke or arm 26 according to a counterclockwise motion. The can 4' is also contained and guided in its rotation by a containment element, for example a circumferential bar 30, which is installed at a useful height for functioning as an external guide, when working with large cans. The said circumferential bar 30 may possibly be lowered or removed, when working with small cans. Set within the processing path is a wall 31 which has the function of containing the cans and the motor members 32 of the gathering device.

Figure 4A:
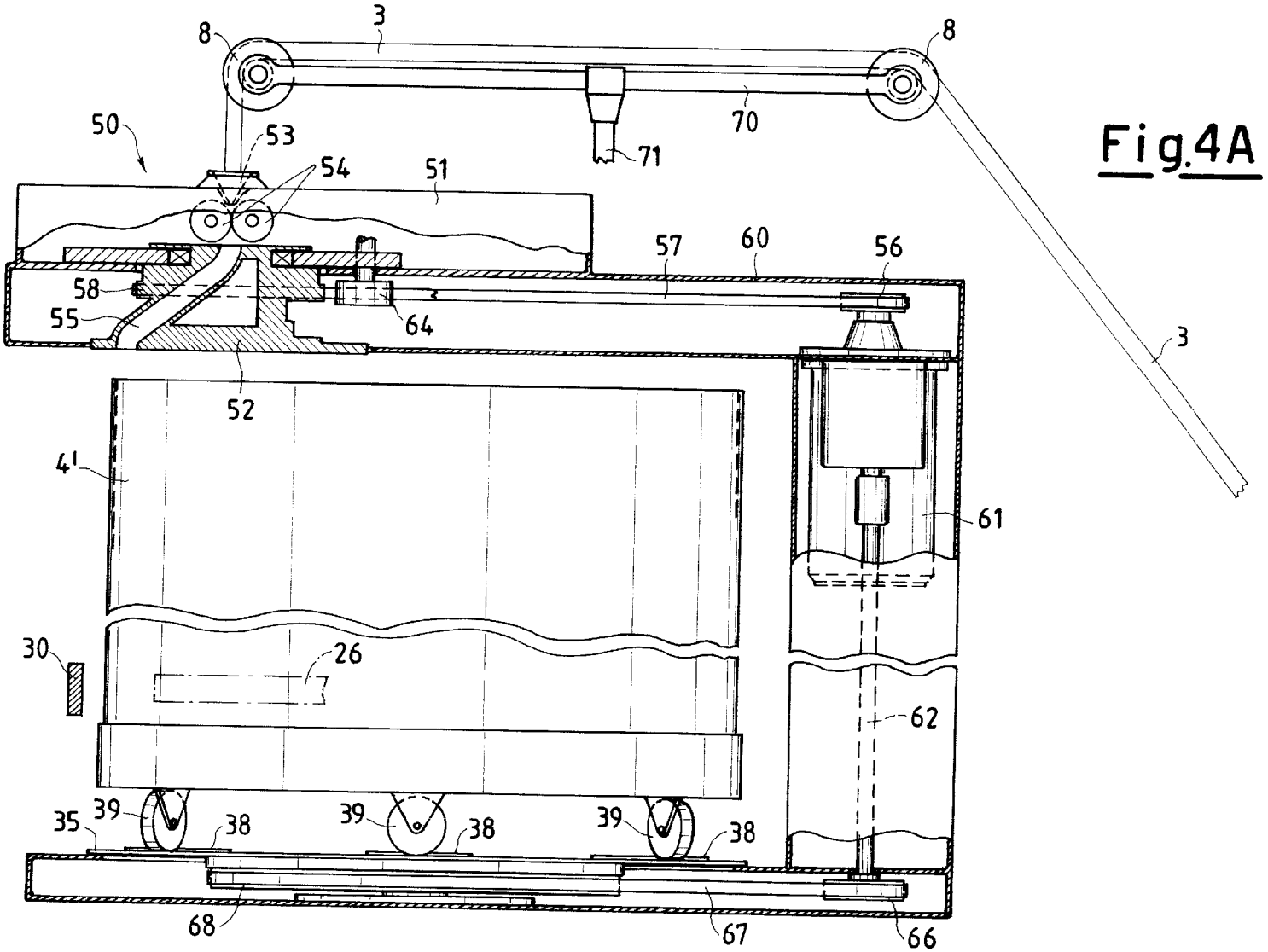
Figure 4B:
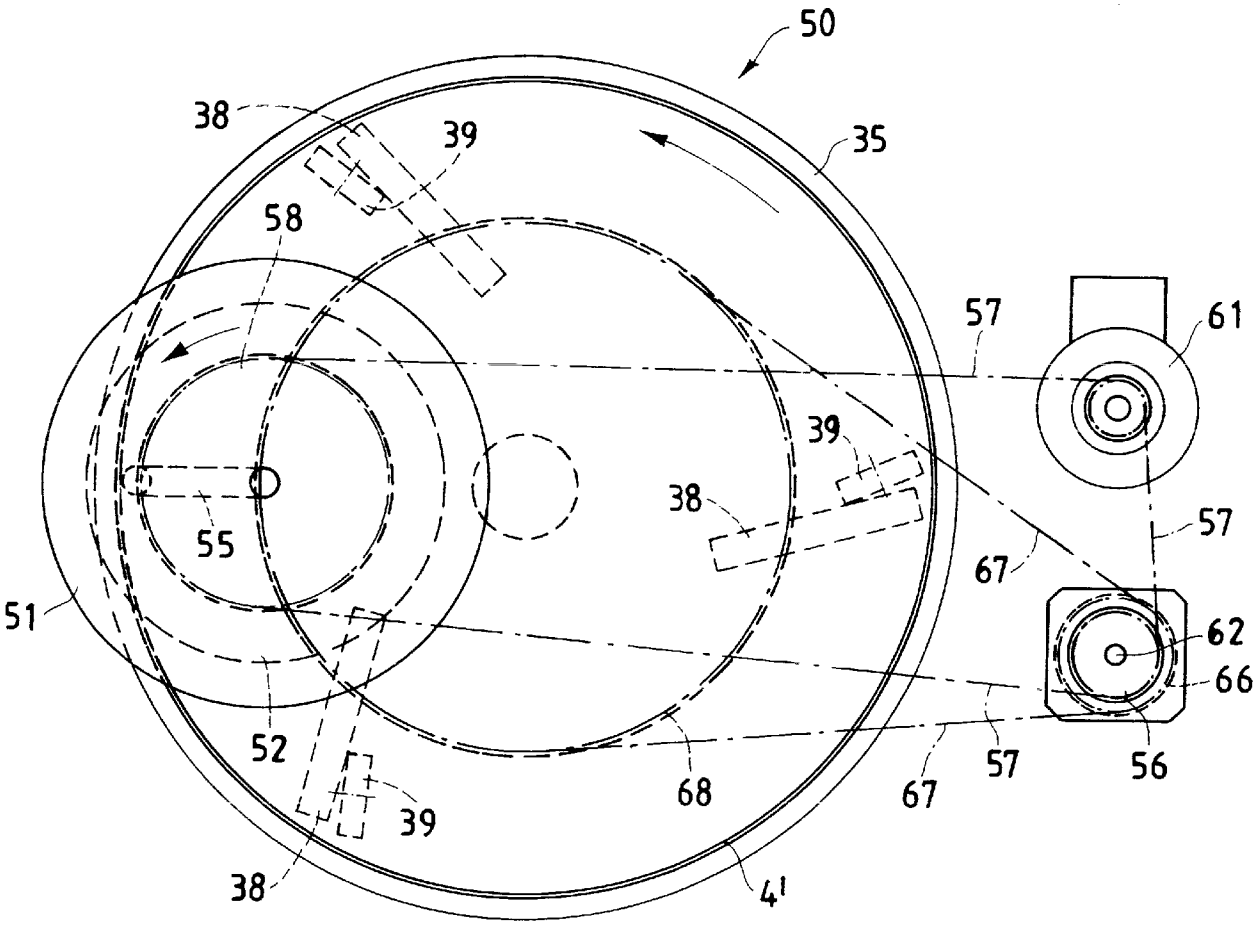

With the first step of movement, the large can 4' is brought into its workstation 21' for gathering the sliver on its rotating platform 35. The precision of this positioning is ensured by an extendible arrest lever 36, which is extended with an interception end equipped with an idle supporting wheel 37 for intercepting and blocking the can 4' in its advance. FIGS. 4A and 4B illustrate the device for distribution of the sliver inside the can 4' or 4".

Figure 1:
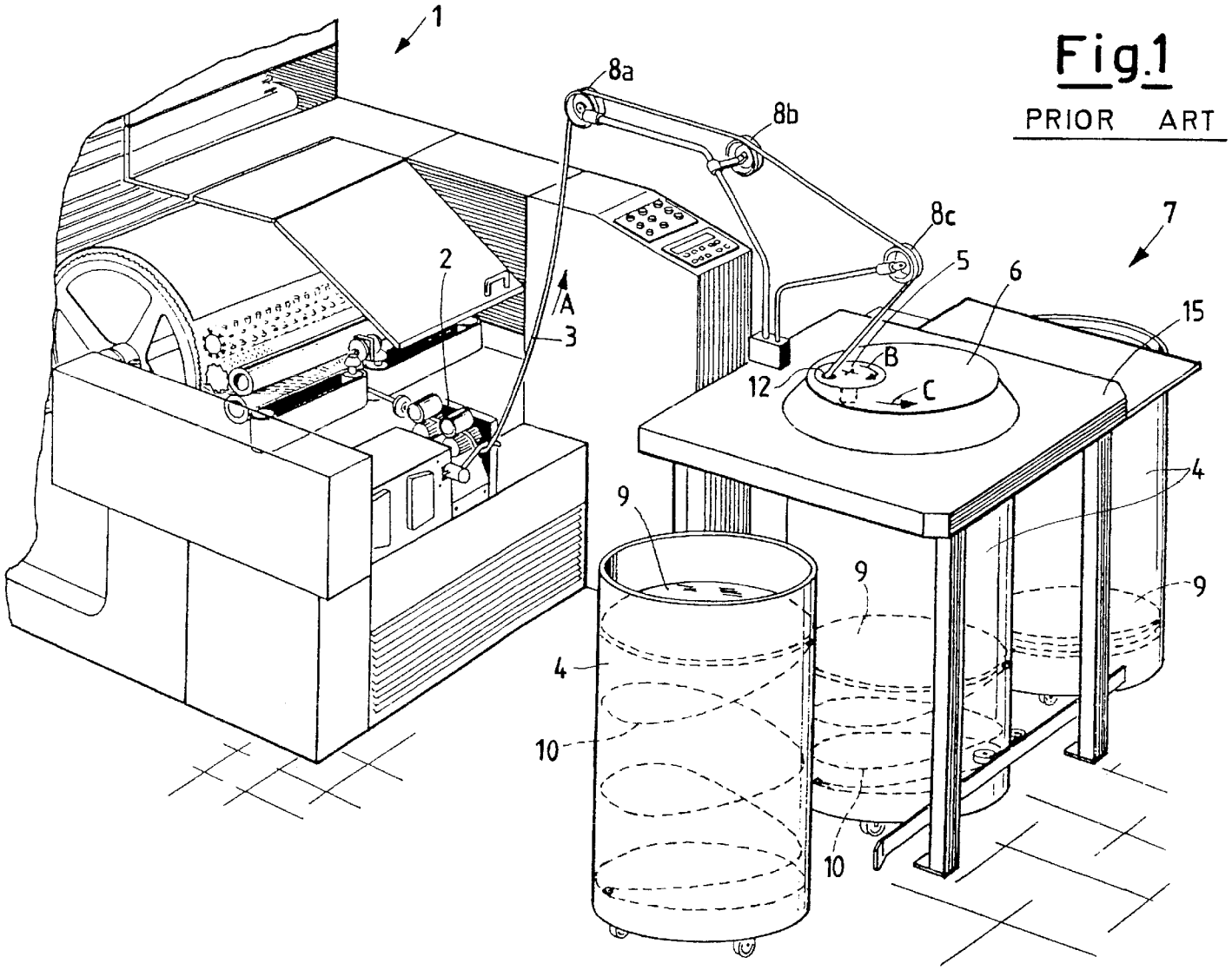
Fig.1 PRIOR ART
FIG. 1 illustrates the scheme for gathering the sliver coming from a card according to the known art in order to illustrate the problems tackled by the present invention.

When the can 4' has reached its gathering station 21' and is centered on its rotating platform 35 to get the axis of rotation of the platform to coincide with the axis of symmetry of the can the operation of gathering the sliver 3 and depositing it in said can 4', which is driven in rotation by the rotary motion of the table 35, starts. Arranged on the surface of the platform 35 are a number of projections 38 which facilitate the action of driving the can 4' in rotation. The sliver 3 accumulates according to a rotating-coil pattern inside the can 4', whilst the bottom of the can progressively drops down so that the portion of free sliver between the mobile plate 52 of the rotating distributor 50 and the layer of sliver on which the sliver is deposited remains short and substantially constant, as illustrated in FIG. 1.

When a can 4' is filled by the amount of sliver envisaged, it is unloaded by being released from the constraint of the arresting element 36 and by being pushed with a counterclockwise motion by the movement-imparting member 22, first towards the station 21" and then to the exit 21'".

In the embodiment illustrated in FIG. 3, the device according to the present invention is illustrated in plan view, and once again without its cover, and in its working configuration with small cans, for example ones having a diameter of 18". For advance of the cans 4", once again the end wheel 27 of each spoke or arm 26 is used, whilst the other wheel 28 set on the hump of each spoke is no longer used. Instead of the latter, the innermost support of the can 4" is provided by a lever 40 set on the advancing part of the spoke 26, said lever 40 being hinged in 41 in the innermost segment of said spoke and being equipped with an internal idle supporting wheel 42 for supporting the can 4". The lever 40 is kept aligned and retracted under the spokes 26 when working with large cans and is instead extended outwards, for example at 90° with respect to the spoke 26 in which it is hinged, when working with small cans.

In each cavity of the member 22, it is thus possible to rest a can 4" on the two wheels 27 and 42, the said can 4" being pushed by its respective spoke 26 according to a counterclockwise motion. The can 4" is likewise guided in its rotation by containment elements installed at a useful height for functioning as guides, for example with an outer circumferential guide 43 and an inner circumferential guide 44 radiused with rectilinear portions up to the position 24 of arrival of the small cans and the position 21'" of exit of the filled cans, in a manner similar to what is envisaged for the large cans. The aforesaid guides are installed each time for the small cans, and are removed when working with the large cans.

The first step brings the small can into a second (waiting) position, whilst, with the second movement-imparting step, the small can 4" is brought into its station 21" for gathering of the sliver on its rotating platform 45. Its positioning is ensured by an extendable arresting lever 46, which extends with an interception end provided with an idle supporting wheel 47 and which intercepts the can 4" as the latter is advancing, in a manner similar to what is described for the arresting element 36 of the large can. Set above the rotating platform 45 is a second rotating distributor 52', which is altogether similar to the one that is set in a position above the platform 35 for the big cans 4'.

The process of gathering and depositing the sliver 3 in the cans 4" is carried out on the rotating platform 45, according to the same modalities as for the large cans 4', for gathering the sliver with the linear speed with which it arrives from the process upstream except for the differences in diameter and speed of rotation of the distributor and of the can due to their different size. When a can 4" is filled with the amount of sliver envisaged for its particular size, it is unloaded by being released from the constraint of the arresting element 46 and by being pushed with a counter-clockwise motion directly towards the exit 21'" by means of the movement-imparting member 22.

The eccentric distributor 50, which distributes the sliver into the underlying can 4' during filling, is mounted on a supporting and service structure 60, which is illustrated in greater detail in FIGS. 4A and 4B, which respectively show a partially sectioned side view and a plan view of a work-station of a gathering system.

The cans 4' are shown mounted on wheels 39 for facilitating their movement. The cans may also be without wheels and may be moved on rollers or on equivalent means known to the state of the art.

The eccentric distributor 50 comprises a fixed top part 51 and a mobile bottom part 52. Contained in the thickness of the distributor 50 are the gears which are driven by a cogged belt, according to kinematic schemes known to the prior art, which enable attainment of the desired speeds of rotation of the mobile part 52 of the distributor 50 and the desired speed of recall of the sliver to be deposited in the can by the fixed part 51. The arrival of the sliver 3 is indicated by two return motions with the pulleys 8, which convey the sliver into a position which is coaxial with the center of the conveyor 53 of the fixed part 51.

According to the size of the gathering can to be served, i.e., the can 4' or the can 4", the device 70 for conveying the sliver with the pulleys 8 is appropriately oriented with respect to the card, its supporting part 71 being positioned, as required each time, on the structure of the device for delivery in a position coaxial with the center of the conveyor 53 of the fixed part 51 of the distributor, the direction being maintained constant without substantial deviations along the path from the card to the gathering point.

The sliver 3 coming from the last of the supporting pulleys 8 enters the fixed part 51 of the distributor 50 through a conveying funnel 53 and from here is recalled with a pair of small calenders 54 driven at a linear speed that is substantially equal to the speed at which the card 1 upstream releases it. From the small calenders 54 the sliver 3 exits from below and enters the rotating part 51 in a deviator duct 55, which is preferably smooth and which generates the coils in the sliver introduced into the can 4', 4" that is being filled. The face forming the underside of the distributor 50 is plain and smooth. It functions as a ceiling and containment crown for the winding of coils that are being deposited by the mobile part of the distributor, the said coils tending to swell and rise upwards, so coming into contact with the ceiling or crown of the structure.

The said ceiling or crown can be extended throughout the perimeter of the sliver-gathering station 21' and 21" up to the exit position 21'". The height of the ceiling is designed so as to remain over the top of the filled can with a very small margin, in order to contain the sliver and prevent it from possibly coming out as a result of the fact that the last part deposited in the can tends to swell, at the same time without preventing sufficiently free movement of the sliver. The plate that forms the ceiling for keeping the sliver contained in the cans is supported by the fixed structure 60.

According to the embodiments of FIGS. 4A and 4B, operation of the various members is distributed in the central part of the device, for example with a motor 61, which transmits motion to a vertical shaft 62, from which the gathering members of the two workstations 21' and 21" alternatively derive their motion. In FIG. 4B are illustrated by way of example the actuating members of the platform 35 of the workstation 21' set for working with large cans 4'. At the same time, it is pointed out that operation of the distributor 50' for small cans 4" follows the same kinematic arrangement, where basically only the diameters of the various parts change.

The motion for actuating the distributor 50 and the platform 35 set beneath it is taken from the vertical shaft 62. Fitted on the top part of the shaft 62 is a gear wheel 56 for transmitting motion to the distributor 50, by means of the cogged belt 57 that meshes and connects the gears 56 and 58 for rotation of the mobile part 52 integrally with its deviator 55. The motion for driving the small calenders 54 is always taken from the cogged belt 57 which, for example, meshes in a gear 64 which, in turn, transmits the motion to the small calenders in a way which is in itself known and which is not indicated in the figure for reasons of simplicity.

In the lowest part of the device there is fitted a second gear wheel 66 for transmission of motion to the platform 35 by means of the cogged belt 67, which meshes and connects the gear wheels 66 and 68 for rotation of the platform 35 with the can 4' set on top of it. According to one embodiment of the invention, which is illustrated by way of example in FIG. 5A, the motor 61 and the shaft 62 impart driving motion on both of the gathering stations. Illustrated, instead, in FIG. 5B is an embodiment in which each of the sliver-gathering stations is equipped with a driving assembly of its own, each having an independent motor 61, 61', which is driven alternatively according to the workstation that is operating. This embodiment enables different transmission ratios to be imparted on the shafts 62, 62' in the two drives.

As already explained, driving of the distributor 50' and of the rotary platform 45 for the small cans 4" follows the same kinematic arrangement, with a platform of smaller diameter and with a distributor 50' with the mobile part 51' of smaller diameter and with a smaller eccentricity with respect to the axis of the platform 45 and of the can 4". In order to gather a sliver 3 released at the same linear rate, the mobile part 51' should, therefore, rotate at a higher speed than the part 51 for the large cans, in a manner inversely proportional to the diameters of the coils deposited in the cans.

Figure 5A:
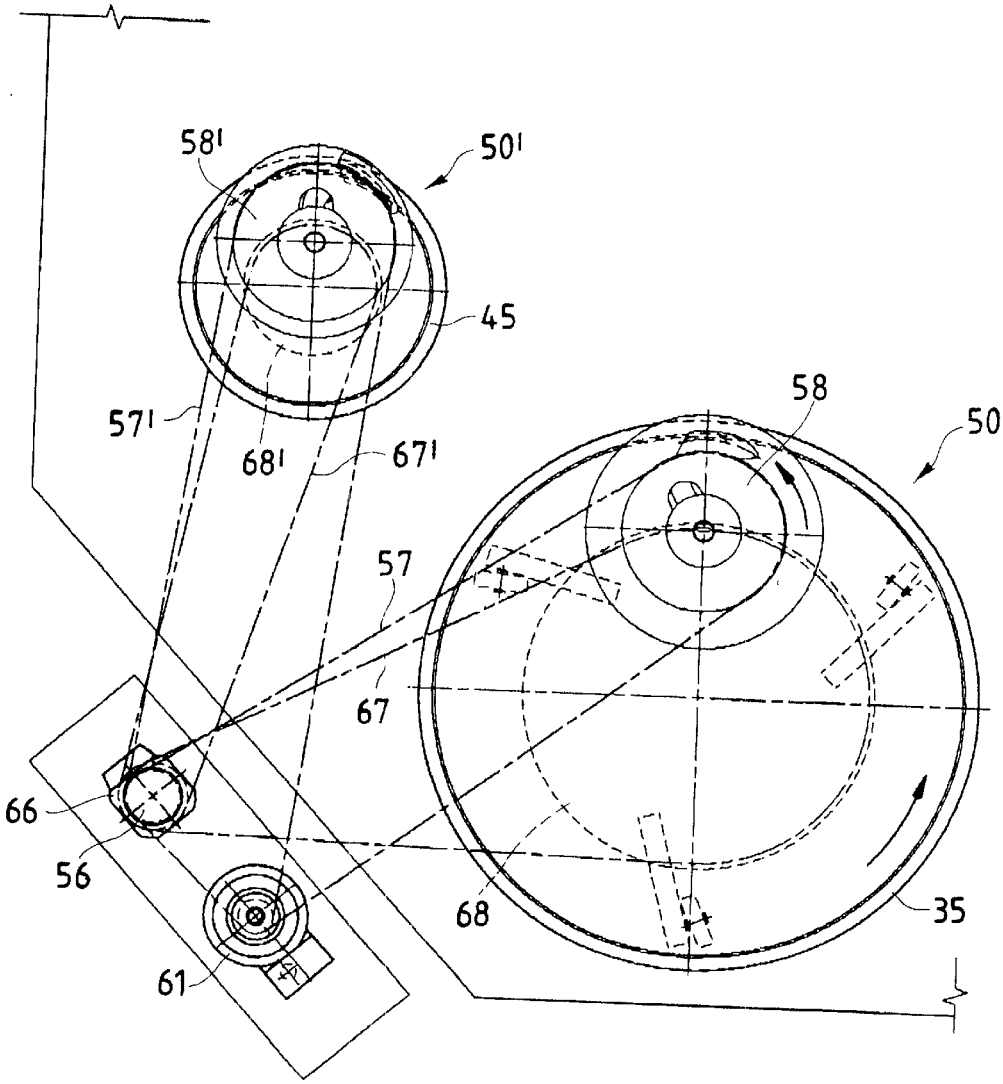
Figure 5B:
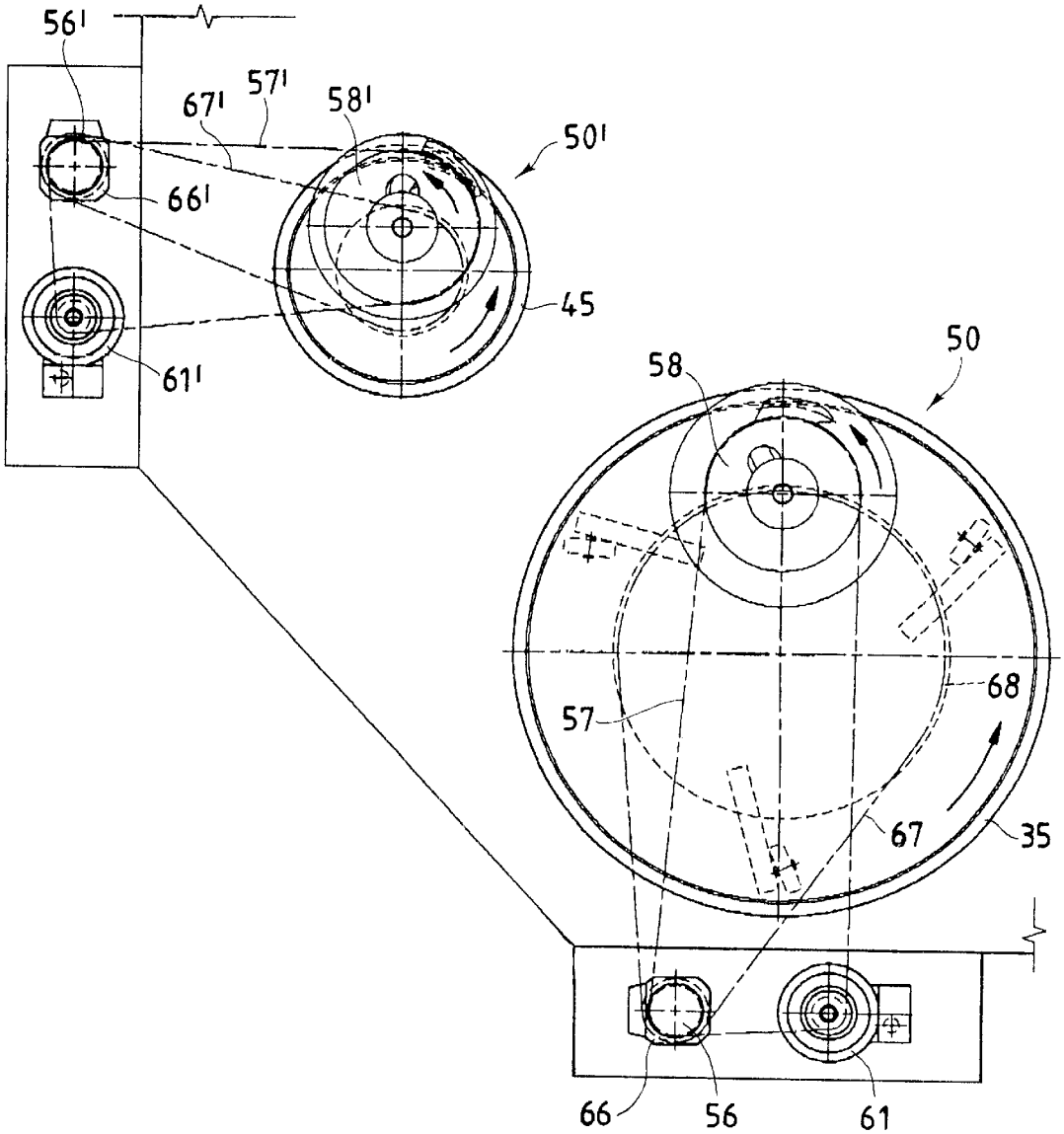

According to the diagram of FIG. 5A, as the dimension of the can changes, the said gear wheels 58 and 68 may be disconnected from being driven with the gears 56 and 66 on the shaft 62. The latter are then connected with the homologous gears of the other platform for driving the other gathering unit. According to an alternative embodiment of the common drive (not illustrated in the figure for reasons of simplicity), in parallel with the gears 56 and 66 fitted on the shaft 62 for transmitting drive to the gathering unit with large cans 4' a second pair of gears 56' and 66' can be fitted, with interposition of engagement devices for alternative engagement of one pair or the other pair, the said engagement devices being in themselves known. The pair of gears 56' and 66' transmit motion to the homologous gears 58' and 68' with homologous cogged belts 57' and 67' for driving the distributor 50' at the top and the rotary platform 45 at the bottom for the latter to receive small cans. In other words, at the ends of the common drive shaft 62, there are fitted pairs of drive gears 56, 66, or else 56', 66', which can be engaged alternatively for either one or the other of the gathering stations by respectively activating their gears 58, 68, or 58', 68' for receiving motion, the said gears being connected by means of the cogged belts 57, 57'. This arrangement would also enable variation of the transmission ratios for the two sizes of cans 4', 4" envisaged, if the homologous gears have a different number of teeth.

In the alternative embodiment with double drive, illustrated in FIG. 5B, the transmission ratios are already prearranged for the size of can envisaged, without having to resort to any engaging and disengaging.

The device according to the present invention is provided with a movement-imparting member for pushing the cans between the positions 21, 21', 22" illustrated previously, the said device consisting of arms 22 for pushing the cans. This arrangement is preferably obtained by setting the arms 22 and the guides 30 at a height close to the base of the can 4' so as to limit the momentum of upsetting the can when one of the wheels 39 of the can were to encounter obstacles along its path.

The device according to the present invention proves able to overcome the drawbacks of sliver-gathering devices according to the prior art and proves particularly advantageous when it is applied downstream of carding machines built according to the European patent applications EP-A-768 399, EP-A-1 001 058, EPA-1 001 059 in the name of the present applicant, which contemplate the production of slivers that have already undergone drawing in the card itself. This circumstance enables the immediate use of the sliver without any supplementary operations of drawing and consequently entails both the caution required in the case of a delicate sliver and a gathering modality in accordance with the parameters required by the values of tensile strength due to the said drawing process with the use of appropriate cans. It is therefore advisable to equip the card in question with a gathering device that is able to work in the most suitable conditions and with variable sizes of the sliver-gathering cans.

The device according to the present invention enables the sliver to be fed to the rotating distributor 50 or 50' with a length of free portion, between the last return of the pulley 8 of the device for delivering the sliver and the small calenders 54 which is constant and exactly coaxial with the funnel 53, without inducing any further drawing action during feeding of the sliver.

The transmission of motion necessary for getting the coils generated by the motion of revolution of the distributor 50 with a rotation of the underlying can 4' or 4", instead of the overlying plate 6 to deposit in the can proves less complicated, less costly and less cumbersome and, for these reasons, less influenced by the size of the can.

What is claimed is:

1. An automatic device for gathering and packaging card sliver (3) in cans (4', 4"), the said sliver being transferred from a card assembly (1) to a gathering assembly (20), which comprises a distributor (50, 50') set over the top of the gathering can (4', 4") and eccentric with respect to the latter, driven by a motion of revolution, whilst the can (4', 4") set underneath is driven by a motion of rotation to distribute, in the can (4', 4"), the sliver according to coils that translate their center according to circles that are coaxial with the can (4', 4"), the said automatic device being characterized in that the gathering assembly (20) is made up of a plurality of gathering stations (21', 21") for specific gathering into cans of different size, there being provided in each workstation (21', 21") a gathering device specific for a given size of can and consisting of a rotary platform (35, 45) set underneath for rotation of the can (4', 4") receiving the sliver and of a distributor (50, 50') driven by the motion of revolution, and in that the gathering assembly (20), in which the cans (4', 4") are alternatively employed, envisages a single common path (21, 21', 22", 22'") for the various sizes of cans, the said path extending from an entrance to an exit, and is equipped with common members for imparting movement with rotating arms (22) and members for positioning the cans (4', 4") in the working position in their specific gathering station (21', 21"), so that the sliver (3) produced by the card assembly (1) can be gathered alternatively, in one and the same gathering device (20), into large-sized cans (4') or else into small-sized cans (4") according to the requirements of use of the sliver in processes set downstream.

2. The automatic device for gathering and packaging card sliver in cans according to claim 1, characterized in that the members for imparting movement on the cans consist of arms (22) for pushing the cans along a circular path, the said arms (22) being equipped with projections for pushing and centering the can, with idle wheels (27, 28, 42) which adapt to the size of the large can (4') or to the size of the small can (4"), extended in an active position, or retracted in an inactive position, of levers (40) set on the arms themselves.

3. The automatic device for gathering and packaging card sliver in cans according to claim 2, characterized in that the member for centering the can (4', 4") consists of an extendable arrest lever (36, 46), which is extended with an interception end provided with a supporting wheel (37, 47) for intercepting and blocking the can (4', 4") in the gathering position, centered on its rotary platform (35, 45) to cause the axis of rotation of the platform to coincide with the axis of symmetry of the can (4', 4").

4. The automatic device for gathering and packaging card sliver in cans according to claim 1, characterized in that the members for containing and guiding the cans (4', 4") consist basically of a circumferential bar (30) for the large cans (4') and an outer circumferential guide (43) and an inner circumferential guide (44) for the small cans (4").

5. The automatic device for gathering and packaging card sliver in cans according to claim 1, characterized in that the device comprises a conveying device (70) for conveying the sliver by means of pulleys (8), the said device being able to undergo positioning and orientation with respect to the card (1) for its delivery in a position coaxial with the center of the conveyor (53), with a constant direction and without any substantial deviation of path from the card to the gathering point.

6. The automatic device for gathering and packaging card sliver in cans according to claim 1, characterized in that the gathering members of the two workstations (21') and (21") receive in common their driving motion from a common motor (61) and from a common shaft (62), on which gear wheels (56, 66) are fitted, the said gear wheels being connected by means of a cogged belt (57, 67; 57', 67') to gears (58, 68; 58', 68') of said workstations, which are alternatively engaged for driving one workstation or the other workstation.

7. The automatic device for gathering and packaging card sliver in cans according to claim 1, characterized in that the gathering members of the two workstations (21') and (21") receive in common their drive from a common motor (61) and from a common shaft (62), on which there are fitted pairs of gear wheels (56, 66; 56', 66'), which can be engaged with alternative engagement devices for one or the other gathering workstation, by activating respectively gear (58, 68; 58', 68'), to which they are connected with cogged belts (57, 67; 57', 67').

8. The automatic device for gathering and packaging card sliver in cans according to claim 1, characterized in that the gathering members of the two workstations (21') and (21") receive their drive each from a motor (61, 61') of its own and from a shaft (62, 62') of its own, which are driven alternatively according to the workstation that is operating.

* * * * *